United States Patent [19]

Coovert et al.

[11] Patent Number: 4,999,539

[45] Date of Patent: Mar. 12, 1991

[54] ELECTRODE CONFIGURATION FOR REDUCING CONTACT DENSITY IN MATRIX-ADDRESSED DISPLAY PANELS

[75] Inventors: Richard E. Coovert; Christopher N. King, both of Portland, Oreg.

[73] Assignee: Planar Systems, Inc., Beaverton, Oreg.

[21] Appl. No.: 445,444

[22] Filed: Dec. 4, 1989

[51] Int. Cl.[5] ..... H05B 33/06; G09G 3/30

[52] U.S. Cl. ..... 313/505; 340/781

[58] Field of Search ..... 313/505, 51; 340/781, 340/825.81; 315/169.1, 169.3

[56] References Cited

U.S. PATENT DOCUMENTS 3,204,106 8/1965 Murr, Jr. et al. ..... 313/505 X 3,638,033 1/1972 Johnson et al. ..... 313/505

*Primary Examiner*—Sandra L. O'Shea

*Attorney, Agent, or Firm*—Chernoff, Vilhauer, McClung & Stenzel

[57] ABSTRACT

An electrode configuration for reducing contact density in matrix-addressed display panels includes a first set of electrodes having termination points for connection to external driving electronics situated near the edge of a supporting substrate, and a second set of electrodes alternately interleaved among said first set having termination points spaced inwardly from the substrate's edge. An insulating film covers the termination points of the second plurality of electrodes and bond pads placed atop the insulating film are connected to the electrodes by leads. This insulates the second plurality of electrodes from a possible short circuit caused by random or one-on-one interconnects that bridge areas in the gaps between the electrodes.

10 Claims, 4 Drawing Sheets

ELECTRODE CONFIGURATION FOR REDUCING CONTACT DENSITY IN MATRIX-ADDRESSED DISPLAY PANELS

BACKGROUND OF THE INVENTION

The following invention relates to a flat panel matrix-addressed display of the type that utilizes orthogonally disposed sets of electrodes sandwiching an electroluminescent medium and provides an electrode configuration for minimizing the effective contact density of the electrodes at the edges of the panel. This allows a higher resolution flat panel display to be served by a lower effective density of interconnects.

Matrix addressed luminescent displays such as thin-film electroluminescent (TFEL) displays include sets of parallel elongate electrodes deposited on a substrate which sandwich a laminate, which includes an electroluminescent phosphor layer, between two dielectric layers. The electrodes include a front transparent set of electrodes deposited on a substrate and a rear set of electrodes oriented perpendicular to the front set. This is a matrix addressable display where the matrix consists of pixel points located at the field-of-view intersections of the front and rear electrode sets. In order to create the electric fields necessary to cause luminescence at these pixel points, the electrodes are connected to driving electronics at contact points along the periphery of the panel.

High resolution panels having a large number of pixel points require a correspondingly large number of electrodes. This in turn leads to very high contact densities along the sides of the display for interconnection to the driving electronics. For example a conventional electrode configuration for flat panel display is shown in FIG. 1, where each matrix display line (for either row or column electrodes) is extended outwardly to the periphery of the panel for electrical connection. This single row of contact pads may be too crowded to accommodate the tolerances available in connectors which are designed to connect these contact pads to the driving electronics.

An alternative type of electrode configuration which has been used in the past is shown in FIG. 2. In this configuration, an interdigitated layout is used. Adjacent lines have contacts at opposite sides of the display in an alternating fashion, which effectively reduces the contact density to half of that of FIG. 1. This may not be practical, however, for some drive schemes, particularly those used with TFEL panels, because the driving electronics may need to connect to all lines at one end of the panel. In these cases one possible solution, which is shown in FIG. 3, is to fan out the ends of the electrodes toward the edge of the panel in order to provide more room between termination points. This, however, requires a larger border area which may be inconsistent with design goals regarding the size of the panel and the area needed for the visual display.

In some cases it may be possible to reduce the contact density by arranging the contacts for adjacent display lines to be staggered into N rows. This type of layout is shown in FIG. 4. For example if N=2 the contact pads in the outer row connect to every other display line, and pads in the inner row connect to the remaining alternate display lines. The conducting leads routed to the outer row of contact pads pass in between the pads of the inner row of contacts. If these leads are narrower than the inner row pad separations, the inner and outer row pads may have a pitch (center to center distance) that is twice that of the display lines without fanning. This may result in a net reduction in connection difficulty for some connectors, particularly matched one-on-one types. However, the inner row will still have as many conductors as there are display lines, so there is no real reduction in number density. In high resolution panels which require a large number of lines per unit area, this may limit the acceptable tolerances for connectors to driving electronics.

The means used for connecting the contact pads to the driving electronics must do so without forming short-circuits between adjacent contact pads. When conductors occupy the space between adjacent pads, the tolerance for misalignment is substantially reduced. This is a potential problem with the staggered row approach shown in FIG. 4 using conventional conductor-on-elastomer unaligned or random interconnects. These are conductor-on-elastomer connectors which have a higher resolution than the pads being interconnected so that only the two mating sets of pads being interconnected require alignment. The connectors in between are not aligned to either set. However, for high contact densities, the chances for forming a short-circuit are substantial with the staggered geometry of FIG. 4. Even with a one-on-one type of connector there must be careful alignment or an overhanging portion may short to any conductors routed near the pads.

SUMMARY OF THE INVENTION

The problems identified above are solved by the present invention which provides an electrode configuration for a matrix-addressed display which includes at least one electrode layer deposited on a substrate including a first plurality of parallel electrodes arranged to have their termination points adjacent an edge of the substrate and a second plurality of parallel electrodes interleaved among the first plurality in alternating fashion. The second plurality has its terminating ends set back a distance farther from the edge than the termination points of the first plurality thus forming a staggered row geometry. An insulating film is deposited on top of the electrode layer at a distance set back from the edge to expose the terminating ends of the first plurality of electrodes for electrical connection. A set of conductive pads, one for each electrode in the second plurality, is situated atop the insulating film and is electrically connected to respective electrodes in the second plurality. This provides the advantage of a staggered geometry near the edge of the display without the problem of reduced tolerances caused by conductors occupying the gaps between the inwardly-situated contact pads. The insulating film covers these electrodes while the contact pads situated on top of the insulating film are connected to their respective electrodes by leads extending across the film to the uncovered portions of the electrodes.

The insulating film may comprise a narrow strip which extends perpendicular to the first and second pluralities of electrodes or, in the alternative, it may comprise a thin-film layer covering the entire active length of the electrodes. In the latter case, contact is made through the insulating layer to the second plurality of electrodes by forming voids or vias in the insulating layer at the contact pads. In either case, potential misalignment of the electrode-to-driver connectors ceases to be a problem because any overhang touches only the insulating film and not any adjacent electrode.

This is true either for random interconnects or one-on-one connectors.

It is a principal object of this invention to provide an electrode configuration for a flat panel matrix-addressed display which permits high resolution without the attendant problems resulting from high contact density along the edge of the display.

A further object of this invention is to provide a staggered electrode configuration geometry that solves the problem of internal shorting between conductors for standard interconnects.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 5:
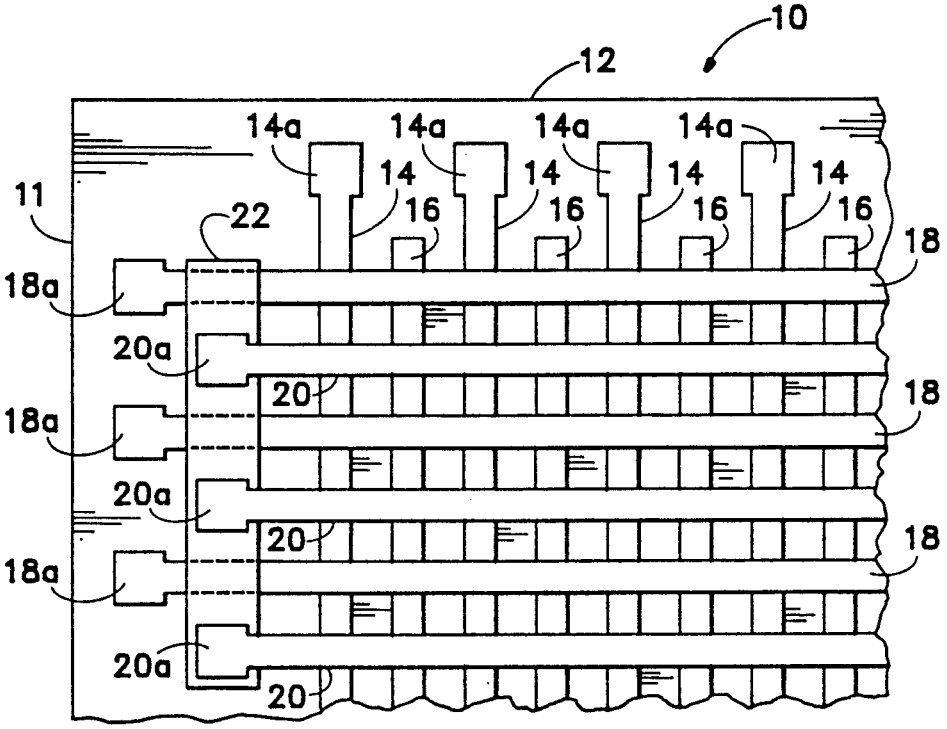
FIG. 5 is a plan view of a portion of a matrix-addressed display illustrating one embodiment of the present invention.

Referring to FIG. 5, a TFEL panel 10 includes a substrate 12 having a set of column electrodes 14 deposited on the substrate 12. The column electrodes 14 extend from the top to the bottom of the panel and have termination points 14*a* near the top adjacent the edge of the substrate. The electrodes 14 are interdigitated with column electrodes 16 which extend from the bottom of the screen (not shown) to the top.

A first plurality of row electrodes 18 have termination points 18*a* located a short distance from an edge 11 of the substrate 12, and a second plurality of row electrodes 20 is interleaved in alternating fashion among row electrodes 18 and include second termination points 20*a* spaced inwardly from the termination points 18*a* with respect to the edge 11 so as to be staggered in distance with respect to the edge 11 of the substrate 12. A thin strip of insulating material 22 extends perpendicular to both the electrodes 18 and the electrodes 20 and overlays a portion of the electrodes 18. The termination points 20*a* of electrodes 20 are situated atop the strip 22.

In accordance with the conventional structure of TFEL panels, the electrode sets 18 and 20 and column electrodes 14 and 16 sandwich a laminate which includes a thin film electroluminescent layer sandwiched between a pair of dielectric layers (not shown). The thin strip 22 covers conductive portions of the electrodes 18 (shown in dashed line in FIG. 5). Thus any interconnects that are used to connect to the termination points 20*a* of electrodes 20 and that stray into the gaps between the termination points 20*a* will rest on the insulating strip 22 and will not make electrical contact with the electrodes 18.

Figure 6:
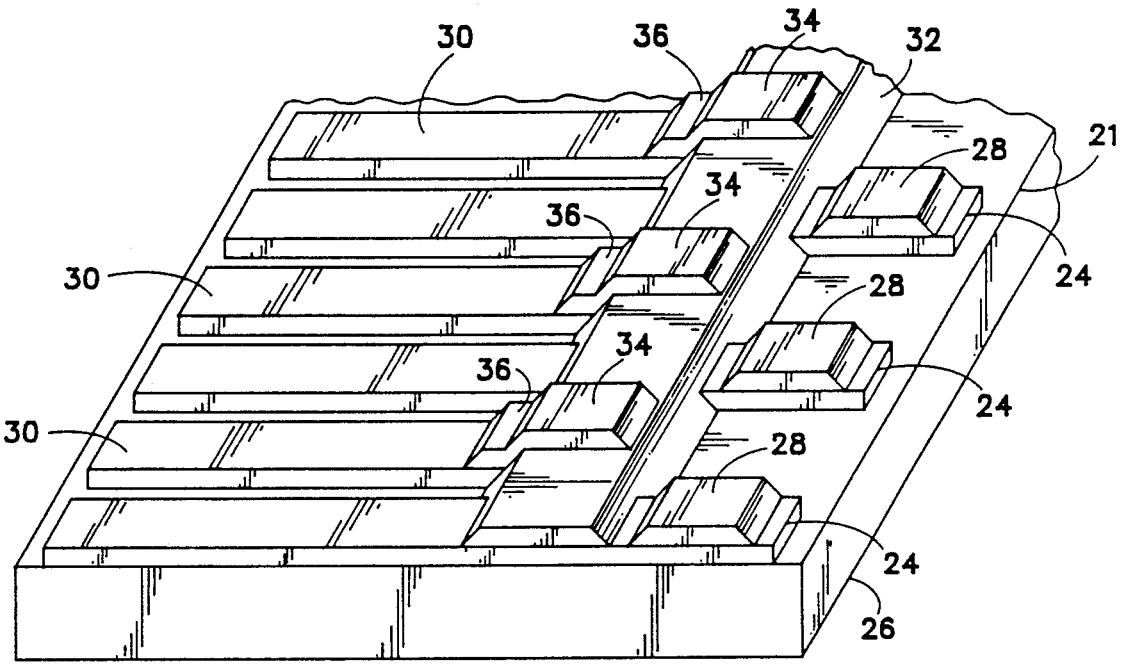
FIG. 6 is a partial perspective view of the matrix-addressed display of FIG. 5.

A variation of the concept shown in FIG. 5 is illustrated in FIG. 6. A first set of electrodes 24 is deposited on a substrate 26. These electrodes have contact pads 28 bonded to the terminating ends of electrodes 24 a short distance from the edge 21 of the substrate 26. A second set of electrodes 30 have termination points (not shown) that lie beneath a strip of insulating material 32. These termination points are spaced further inwardly from the edge 21 of the substrate 26 than the termination points of the electrodes 24. Contact pads 34 are situated over the insulating strip 32 and have leads 36 which extend away from the edge 21 of the substrate 26 to make contact with the electrodes 30 inwardly of the insulating strip 32.

Figure 7:
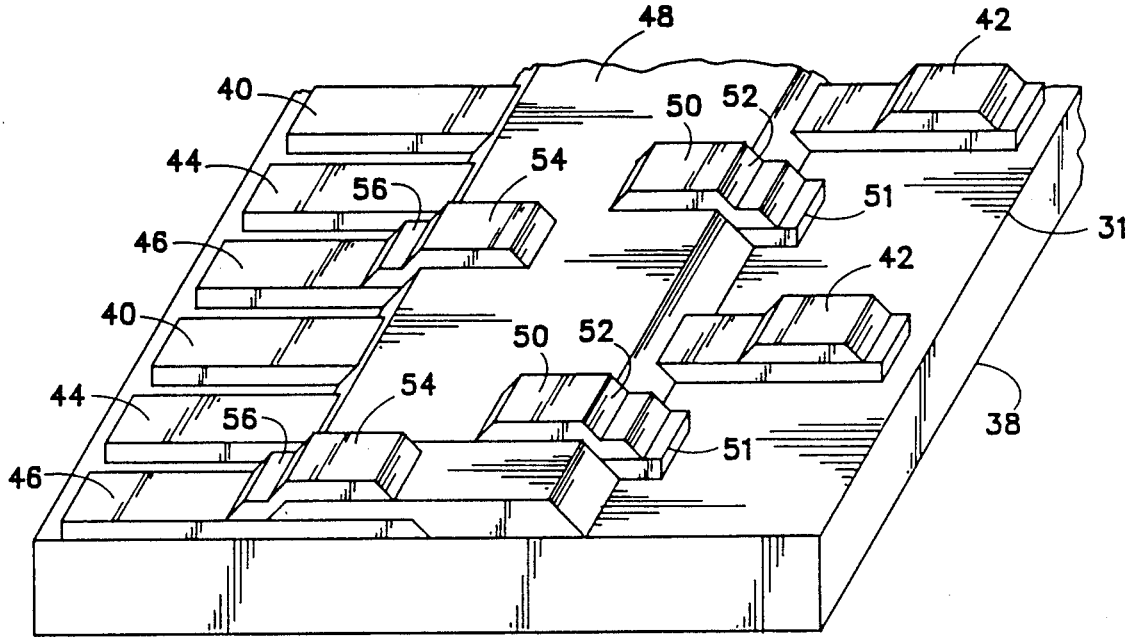
FIG. 7 is a perspective view of a portion of a matrix-addressed display illustrating a second embodiment of the invention.

Another embodiment of the invention is shown in FIG. 7. In this embodiment three sets of electrodes are staggered distancewise from the edge 31 of a substrate 38. Electrodes 40 have termination points adjacent the edge 31 of the substrate 38 with bond pads 42 adhered thereto. Spaced inwardly from the edge 31 are electrodes 44 and 46. An insulating strip 48 overlies the termination points of electrodes 46 but the termination points of electrodes 44 extend slightly past the insulating strip 48 towards the edge 31 of the substrate 38. The electrodes 44 include bond pads 50 which have leads 52 connecting them to the terminating points 51 of the electrodes 44. The terminating points 51 extend only slightly outwardly of the insulating film 48 and thus do not occupy the space in the gap between electrodes 40 where the bond pads 42 are situated. Electrodes 46 are constructed the same as in FIG. 6 with bond pads 54 having leads 56 connected to the electrodes 46 inwardly of the insulating film 48.

Figure 8:
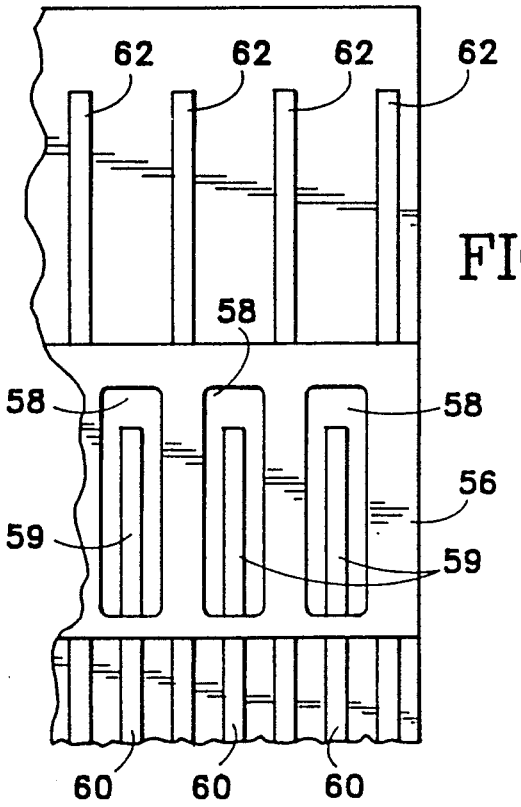
FIG. 8 is a plan view of a portion of a matrix-addressed display illustrating a third embodiment of the invention.

Yet another embodiment of the invention is shown in FIG. 8. In this embodiment a thin insulating film 56 is patterned to include voids or apertures 58 exposing the terminating ends 59 of electrodes 60. Thus, contact may be made with portions adjacent the terminating ends 59 of electrodes 60 without shorting out onto electrodes 62 which are underneath the insulating film 56.

Figure 1:
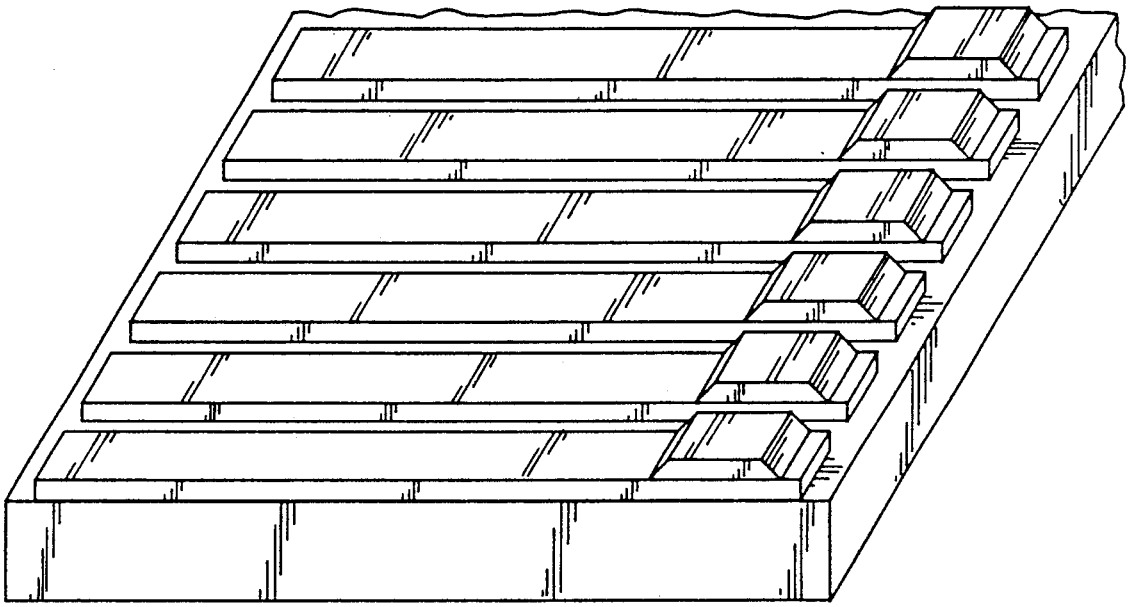
FIG. 1 PRIOR ART
FIG. 1 is a perspective view showing a portion of a prior art display using a single contact row of electrodes.
Figure 2:
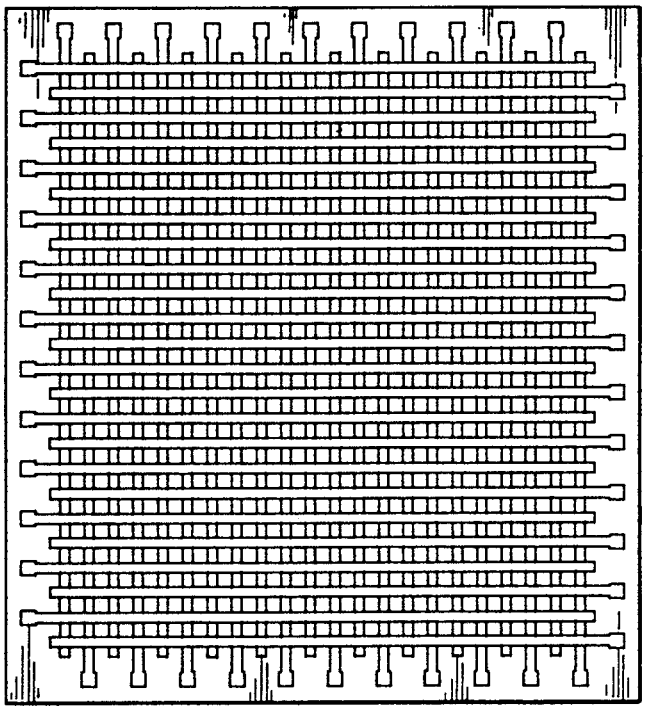
FIG. 2 PRIOR ART
FIG. 2 is a plan view of a prior art matrix-addressed panel having interdigitated row and column contacts.
Figure 3:
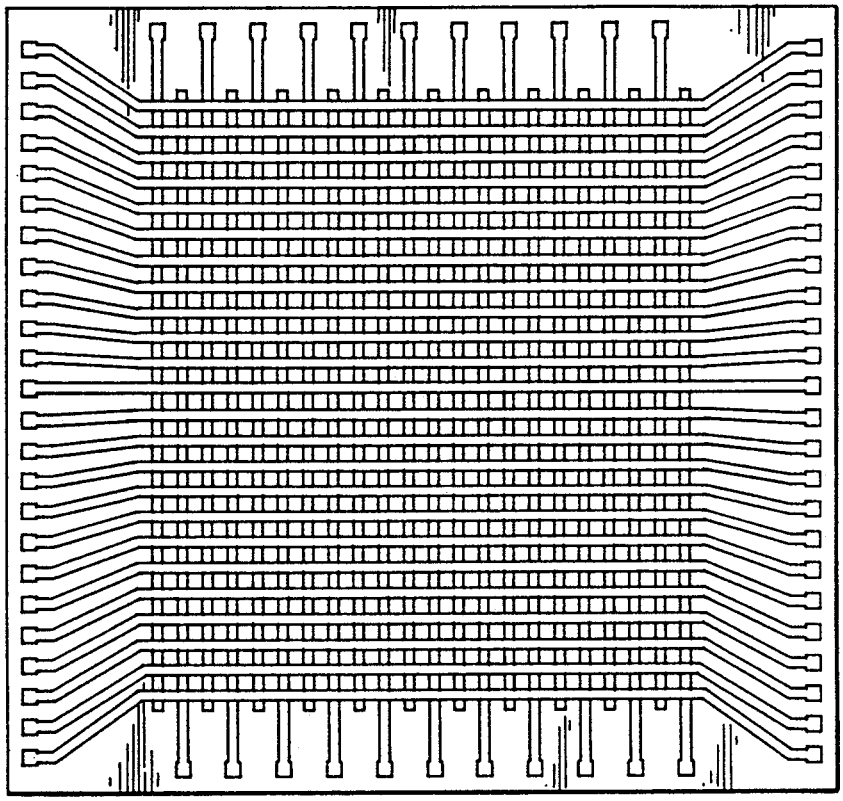
FIG. 3 PRIOR ART
FIG. 3 is a plan view of a prior art matrix-addressed panel having interdigitated column contacts and row contacts at both ends of each line fanned out to lower the contact density.
Figure 4:
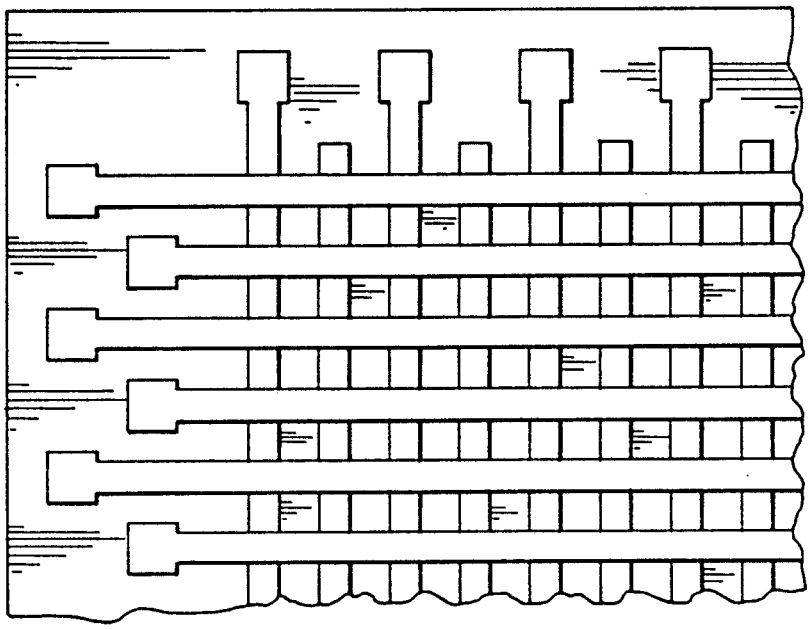
FIG. 4 PRIOR ART
FIG. 4 is a plan view of a portion of a matrix-addressed prior art panel having interdigitated column contacts and row electrodes split into two sets of rows of staggered contacts.

The invention thus takes advantage of a staggered geometry for arranging the electrodes as shown in FIG. 4 without the attendant problem of short circuits caused by the high density of lines at the terminating points of the electrodes that are set back from the edge of the substrate.

The terms and expressions which have been employed in the foregoing abstract and specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. An electrode configuration for a TFEL panel comprising a first electrode layer deposited on a substrate including a first plurality of parallel electrodes arranged on said substrate to have first termination points a predetermined distance from an edge of said substrate, and a second electrode layer including a second plurality of parallel electrodes interleaved among the first plurality in alternating fashion, said second plurality of electrodes having termination points set back a distance farther from said edge than said first termination points, an insulating film deposited on top of at least a portion of said first electrode layer and set back from said edge so as to expose said first termination points for electrical connection wherein said second plurality of electrodes includes contact points for each electrode in said second plurality situated atop said insulating film.

2. The electrode configuration of claim 1 wherein said insulating film comprises a narrow strip extending perpendicular to said first and second pluralities of electrodes.

3. The electrode configuration of claim 2 further including conductive pads on top of said insulating film connected to respective ones of said second plurality of electrodes by leads that extend from said pads colinearly with said second plurality of electrodes to contact points at an edge of said narrow strip of insulating film.

4. The electrode configuration of claim 3, further including a third plurality of electrodes interleaved among said first and second pluralities in alternating fashion and having third termination points extending from underneath said film toward said edge but spaced from said edge a distance intermediate between said first termination points and said second termination points, and having a second plurality of conductive pads situated atop said insulating film and electrically connected to said third plurality of electrodes by leads extending from said pads toward said edge.

5. An electrode configuration for a TFEL panel comprising:

(a) a first plurality of elongate parallel electrodes extending across a substrate, said electrodes having first termination points adjacent a first edge of said substrate;

(b) a second plurality of elongate parallel electrodes interspersed alternately between the electrodes of said first plurality and extending across said substrate, said second plurality of electrodes having second termination points spaced inwardly from said first termination points relative to said edge;

(c) insulator means extending across at least portions of both pluralities of electrodes and having an outer edge set back from said first edge so as to expose said first termination points for electrical connection; and (d) electrical contact means for providing said second plurality of electrodes with electrical connections accessible from above said insulator means.

6. The electrode configuration of claim 5 wherein said contact means comprises conductive contact pads arranged atop the insulator means and having leads connected to respective ones of said second plurality of electrodes.

7. The electrode configuration of claim 5 wherein said insulator means comprises a strip of insulating material extending perpendicular to said first and second pluralities of electrodes.

8. The electrode configuration of claim 6 wherein said conductive contact pads include leads extending away from said first edge of said substrate to make electrical contact with said second plurality of electrodes along an inside edge of said strip of insulating material.

9. The electrode configuration of claim 6 wherein said insulating means includes voids to expose portions of said second plurality of electrodes to thereby permit electrical connection thereto.

10. The electrode configuration of claim 9 wherein said contact pads are situated over said voids and are in direct contact with said portions of said second plurality of electrodes.

* * * * *